US006166635A

United States Patent [19]

Huang

[11] Patent Number: 6,166,635

[45] Date of Patent: Dec. 26, 2000

[54] RADIO BURGLAR ALARM SYSTEM FOR TRAVEL BAG

[76] Inventor: Dennis Huang, 5F, No, Lane 9, Ningpo E. St., Taipei, Taiwan

[21] Appl. No.: 09/352,935

[22] Filed: Jul. 14, 1999

[51] Int. Cl.[7] ..... G08B 13/14

[52] U.S. Cl. ..... 340/571; 340/568.1; 340/539; 340/686.6; 340/328

[58] Field of Search ..... 340/571, 568.1, 340/572.1, 573.4, 686.6, 539, 529, 328, 502, 505, 825.54

[56] References Cited

U.S. PATENT DOCUMENTS

| | | | |
|---|---|---|---|
| 4,871,997 | 10/1989 | Adriaenssens et al. | 340/539 |
| 5,001,460 | 3/1991 | Basson | 340/571 |
| 5,043,702 | 8/1991 | Kuo | 340/539 |
| 5,126,719 | 6/1992 | DeSorbo | 340/571 |
| 5,223,815 | 6/1993 | Rosenthal et al. | 340/539 |
| 5,510,768 | 4/1996 | Mann | 340/571 |
| 5,650,774 | 7/1997 | Drori | 340/825.32 |
| 5,781,109 | 7/1998 | Nakajima | 340/568.1 |
| 5,801,627 | 9/1998 | Hartung | 340/568.1 |
| 5,963,131 | 10/1999 | D'Angelo et al. | 340/568.1 |

*Primary Examiner*—Daniel J. Wu
*Assistant Examiner*—Toan Pham
*Attorney, Agent, or Firm*—Bacon & Thomas, PLLC

[57] ABSTRACT

A radio burglar alarm system for travel bag includes a transmitter unit and at least one receiver unit, the transmitter unit transmitting one of a set of control signals, each receiver unit including a control switch controlled by the control signal from the transmitter unit to close/open the circuit, a vibration sensor for detecting a vibration of the respective receiver unit, and an alarm circuit controlled by the vibrations sensor to output an alarm signal. The control switch of each receiver unit closes the circuit between the vibration sensor and alarm circuit of the respective receiver unit when receiving no signal from the transmitter unit, enabling the alarm circuit to be triggered by the corresponding vibration sensor when the corresponding vibration sensor detects a vibration of the respective receiver unit. The transmitter unit has an emergency button, which directly drives the alarm circuit of each receiver unit to activate the alarm when depressed.

7 Claims, 4 Drawing Sheets

RADIO BURGLAR ALARM SYSTEM FOR TRAVEL BAG

BACKGROUND OF THE INVENTION

The present invention relates to a radio burglar alarm system for a travel bag, and more particularly to such a radio burglar alarm system which uses a vibration sensor to detect the condition of the travel bag under protection, and to drive an alarm circuit upon detection of a vibration of the travel bag.

A regular radio burglar alarm system for a travel bag is generally comprised of a transmitter and an alarm. The transmitter is carried on the user's body. The alarm is put in the travel bag to be protected. The alarm comprises a buzzer, and an alarm control switch. When the distance between the transmitter and the alarm surpasses a predetermined safety range, the alarm is triggered to buzz. However, the problem arises that even if the travel bag is well protected at a safe place, when the user leaves the travel bag and moves beyond the safety range, then alarm will buzz if the user forgets to switch off the radio burglar alarm system. Further, because the alarm control switch is directly installed in the alarm, it can easily be switched off or damaged by a burglar to stop the buzzer from working.

SUMMARY OF THE INVENTION

The present invention has been accomplished to provide a radio burglar alarm system, which eliminates the aforesaid drawbacks. It is one object of the present invention to provide a radio burglar alarm system, which provides a vibration detection action to prevent a false alarm action. It is another object of the present invention to provide a radio burglar alarm system, which enables the user to command the system to immediately trigger an alarm when desired. A radio burglar alarm system according to the present invention comprises a transmitter unit, and at least one receiver unit respectively maintained in communication with the transmitter unit by radio. The transmitter unit is carried on the user's body. Each receiver unit is put in a respective travel bag to be protected. The transmitter unit comprises a signal encoder, a radio transmitting circuit, and a set of control buttons. Each control button produces a respective control signal. The user can control the control buttons to output one of a set of control signals to every receiver unit. Each receiver unit comprises a radio receiving circuit, a signal decoder, a control switch, a vibration sensor, and an alarm circuit. The control switch acts subject to the nature of the control signal received from the transmitter unit. The vibration sensor detects a vibration of the respective receiver unit. The alarm circuit has an alarm device connected thereto, and is controlled by the vibration signal from the vibration sensor, or the control signal from the control switch, to output an alarm signal. The alarm device can be a buzzer, a flashing device, or a high voltage discharging device. When the distance between the transmitter unit and each receiver unit is within a predetermined safety range, the vibration sensor is off. At this stage, the alarm circuit can be triggered only by operating the control buttons to drive the control switch of the respective receiver unit. When the distance between the transmitter unit and one receiver unit surpasses the predetermined safety range, the vibration sensor of the respective receiver unit is turned on to detect a vibration of the respective receiver unit, and the alarm circuit of the respective receiver unit is triggered to output an alarm signal if the receiver unit or the travel bag is moved at this stage. An emergency button and a stop button are provided at the transmitter unit. In case of an emergency, the user can operate the emergency button to drive the alarm circuit of every receiver unit. For example, if the user cannot see the travel bags when in a public place, or the user sees someone stealing the travel bags, the user can depress the emergency button to trigger the alarm circuit of each travel bag regardless of whether the travel bags are within the safety range or not. The user can also depress the emergency button to trigger the alarm circuit when requesting help. When the stop button is depressed, the alarm circuit of each receiver unit is immediately stopped.

DETAILED DESCRIPTION OF THE PREFERRED EMBODIMENT

Figure 1:
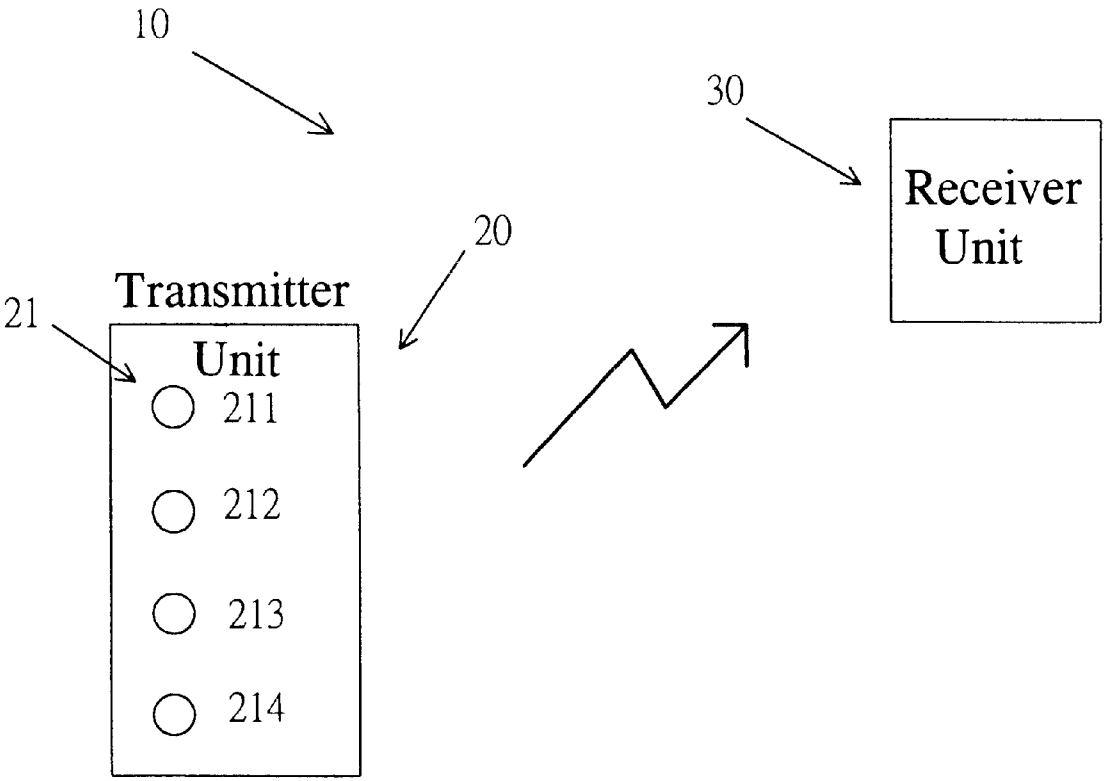
FIG. 1 illustrates the arrangement of a radio burglar alarm system according to the present invention.

Referring to FIGS. from 1 through 3, a radio burglar alarm system 10 is shown comprised of a transmitter unit 20, and a receiver unit 30.

Figure 2:
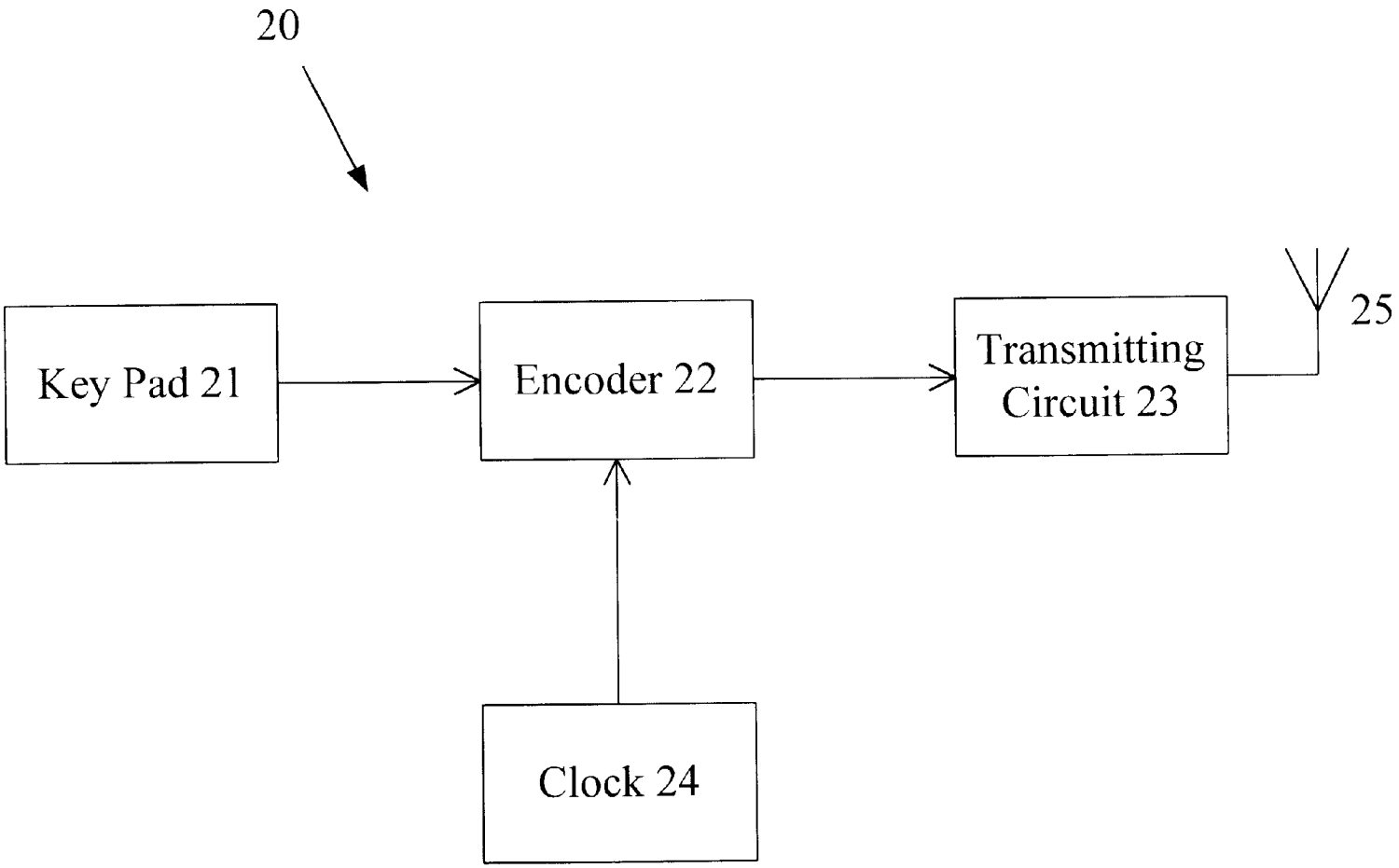
FIG. 2 is a circuit block diagram of a transmitter unit for a radio burglar alarm system according to the present invention.

The transmitter unit 20 comprises a control key pad 21, an encoder 22, a transmitting circuit 23, and a time series generator (clock) 24. As illustrated in FIG. 1, the control key pad 21 comprises "On" button 211, "Off" button 212, "Stop" button 213, and "Emergency" button 214. These buttons 211, 212, 213 and 214 produce a respective control signal when depressed. Alternatively, "On" button 211 and "Off" button 212 may be combined into an On/Off button. The control signal which is produced by one of the buttons 211, 212, 213 and 214 is encoded by the encoder 22, then transmitted into the air by the transmitting circuit 23 through a transmitting antenna 25 (see FIG. 2). The time series generator 24 controls the frequency of the transmission of radio waves. Because radio transmitting techniques are of the known art and not within the scope of the present invention, they are not described in detail.

The receiver unit 30 comprises a receiving circuit 31, a decoder 32, a control switch 33, a vibration sensor 34, an alarm circuit 35, and a time series control 36. The receiving circuit 31 receives a radio signal from the transmitter unit 20 through a receiving antenna 37. The received radio signal is decoded by the decoder 32, and then sent to the control switch 33 by means of the control of the time series control 35, causing the control switch 33 to run a corresponding action. The vibration sensor 34 is an angle detection switch. When detecting an angle change (a movement of the travel bag), the vibration sensor 34 immediately produces a vibration signal to switch on the control switch 23, thereby causing the alarm circuit 35 to trigger an alarm device 40, for example a buzzer 41. Alternatively, the alarm device 40 can be a visual alarm that produces a visual flashing alarm signal. In order to save cost and reduce dimension, the control switch 33 is a simple switching element made integrally with the alarm circuit 35.

Figure 3:
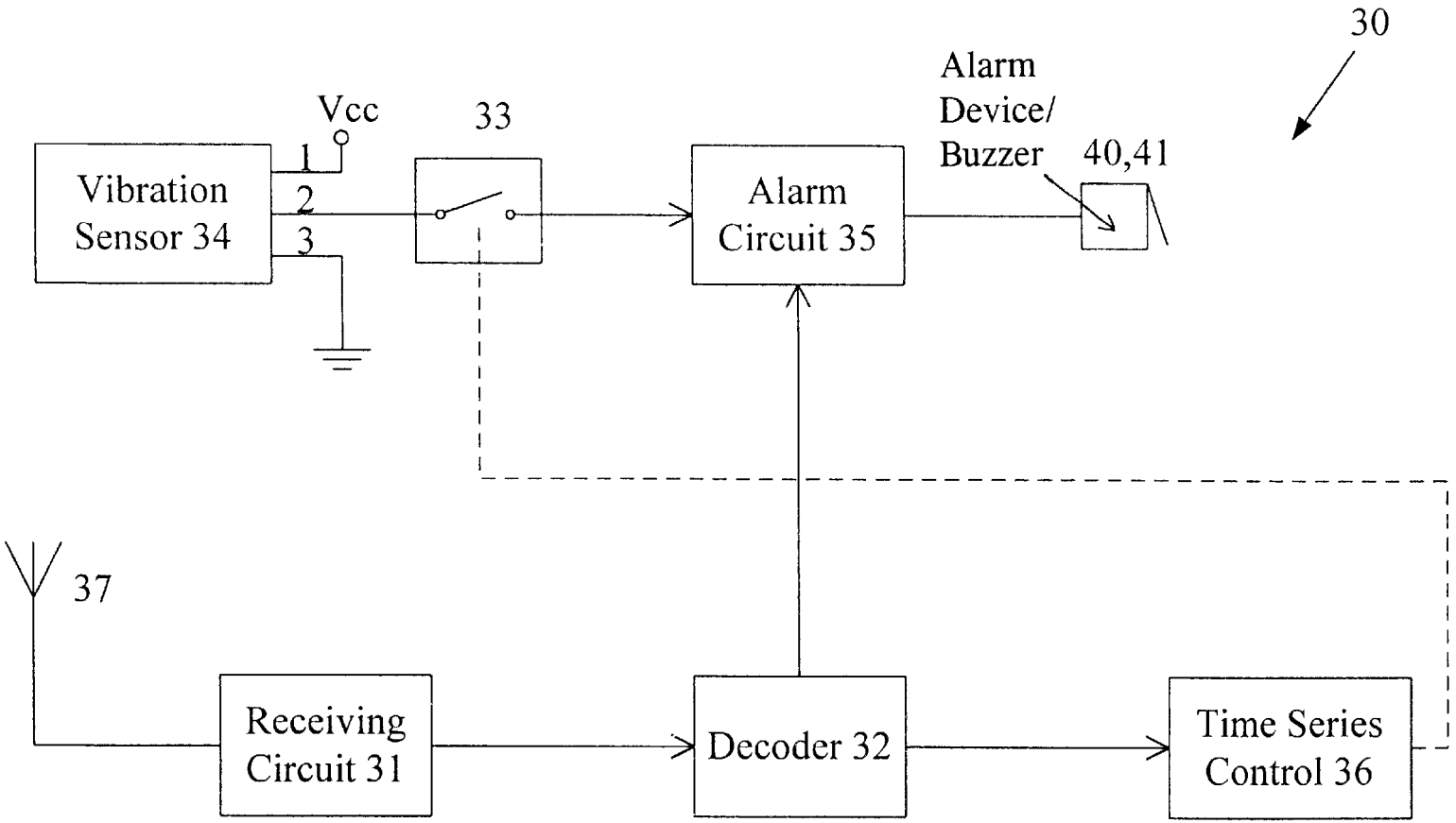
FIG. 3 is a circuit block diagram of a receiver unit for a radio burglar alarm system according to the present invention.
Figure 4:
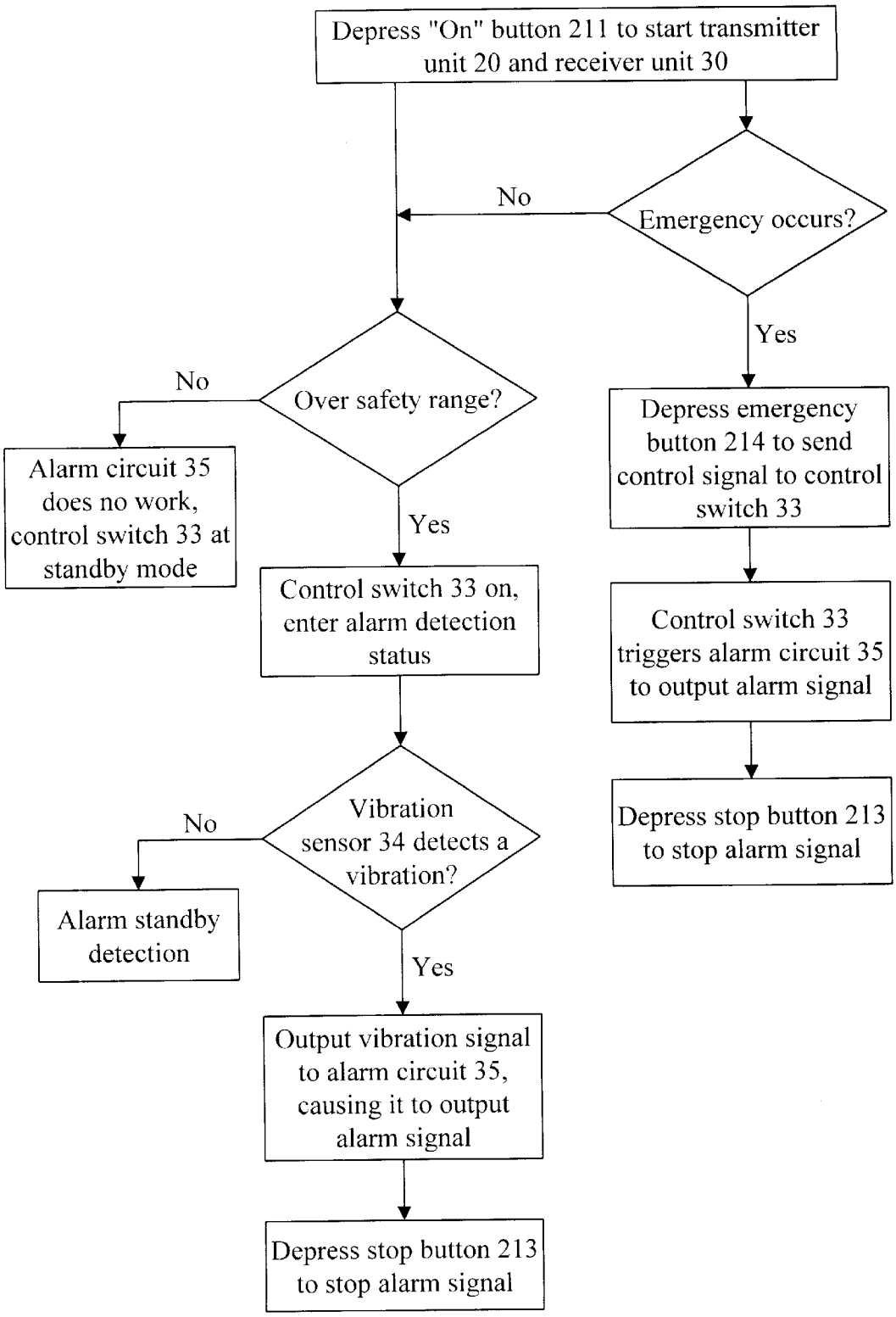
FIG. 4 is an operation flow chart of the present invention.

The operation of the present invention is outlined hereinafter with reference to FIGS. 3 and 4. When in use, the receiver unit 30 is put in the travel bag to be protected, and the transmitter unit 20 is carried on the body of the user. The radio burglar alarm system 10 is started to carry out burglar alarm detection operation by depressing "On" button 211. After starting, the transmitter unit 20 continuously transmit a radio signal to the receiver unit 30 at a predetermined time interval controlled by the time series generator 24. If the distance between the transmitter unit 20 and the receiver unit 30 is within the set effective range, the control switch 33 does no work, and the vibration sensor 34 is in a stand-by mode. If an emergency occurs at this time, the user can directly depress "Emergency" button 214, causing the transmitter unit 20 to transmit an emergency control signal to the control switch 33 of the receiver unit 30. Upon receipt of the emergency control signal, the control switch 33 electrically closes the circuit between vibration sensor 34 and the alarm circuit 35, thereby causing the alarm circuit 35 to output an alarm signal through the alarm device 40. Disarming the alarm is achieved simply by depressing "Stop" button 213.

If the distance between the transmitter unit 20 and the receiver unit 30 is out of the set effective range, the control switch 33 immediately closes the circuit between the vibration sensor 34 and the alarm circuit 35. If the vibration sensor 34 detects a vibration at this stage, the alarm circuit 35 is immediately triggered to output an alarm signal through the alarm device 40. If the user wishes to stop the alarm signal at this time, "Stop" button 213 is depressed.

The user can depress "Emergency" button 214 to command the alarm circuit 35 to trigger an alarm without regard to the distance between the transmitter unit 20 and the receiver unit 30. If "Emergency" button 214 is depressed, the alarm circuit 35 is immediately driven to output an alarm signal through the alarm device 40. The alarm signal is stopped after "Stop" button 213 has been depressed.

Further, one transmitter unit 20 can be used with multiple receiver units 30 to form a radio burglar alarm system 10.

While only one embodiment of the present invention has been shown and described, it will be understood that various modifications and changes could be made thereunto without departing from the spirit and scope of the invention. For example, the aforesaid "Emergency" button and alarm circuit can be designed to act synchronously, i.e., depressing "Emergency" button for a certain length of time causes the alarm circuit to work synchronously for an equal length of time.

What the invention claimed is:

1. A radio burglar alarm system comprising:

a transmitter unit, said transmitter unit comprising a set of control buttons for causing a respective control signal to be generated, an encoder for encoding the control signal from each of said control buttons into a respective encoded signal, and a transmitting circuit for transmitting the encoded signal from said encoder into the air by radio; and at least one receiver unit, said at least one receiver unit comprising a receiving circuit for receiving the radio signal transmitted by said transmitting circuit, a decoder for decoding the radio signal received by said receiving circuit into a decoded control signal, a control switch controlled by the decoded control signal from said decoder to close and open a circuit between a vibration sensor and an alarm circuit, said vibration sensor being for detecting a vibration of said receiver unit and outputting a vibration signal upon the detection of a vibration of said receiver unit, said alarm circuit having an alarm device connected thereto and said alarm circuit being controlled by the vibration signal from said vibration sensor to output an alarm signal through said alarm device;

wherein the control switch of said at least one receiver unit:

I. opens the circuit between the vibration sensor and alarm circuit of the respective receiver unit when continuously receiving the control signal from said transmitter unit, thereby disabling activation of the alarm device in response to the vibration signal when the transmitter unit is within range of the receiver unit, and II. closes the circuit between the vibration sensor and alarm circuit of the respective receiver unit when receiving no signal from said transmitter unit, thereby enabling the alarm circuit of the respective receiver unit to be triggered by the vibration sensor of the respective receiver unit to output an alarm signal though the corresponding alarm device only when (i) the transmitter unit is out of range of the receiver unit, and (ii) the vibration sensor detects a vibration of the receiver unit.

2. The radio burglar alarm system of claim 1 wherein the control buttons of said transmitter unit include an on button for turning on the radio burglar alarm system to be started, and an off button for turning off the radio burglar alarm system.

3. The radio burglar alarm system of claim 1 wherein the control buttons of said transmitter unit include a stop button for turning off the alarm circuit of each of said at least one receiver unit.

4. The radio burglar alarm system of claim 1 wherein the control buttons of said transmitter unit include an emergency button, which drives said alarm circuit to output an alarm signal when depressed.

5. The radio burglar alarm system of claim 1 wherein said vibration sensor outputs a vibration signal when detects an angular condition change of said receiver unit.

6. The radio burglar alarm system of claim 1 wherein said control switch is a normally open switching switch.

7. The radio burglar alarm system of claim 1 wherein said alarm device is a buzzer for providing an audio alarm.

* * * * *